US005327959A

United States Patent [19]

Saperstein et al.

[11] Patent Number: 5,327,959

[45] Date of Patent: Jul. 12, 1994

[54] HEADER FOR AN EVAPORATOR

[75] Inventors: Z. Philip Saperstein, Lake Bluff, Ill.; Gregory G. Hughes, Milwaukee, Wis.; Dan R. DeRosia; Dennis G. Granetzke, both of Racine, Wis.

[73] Assignee: Modine Manufacturing Company, Racine, Wis.

[21] Appl. No.: 919,211

[22] Filed: Sep. 18, 1992

[51] Int. Cl.[5] ..... F28F 9/16; F28D 1/053

[52] U.S. Cl. ..... 165/173; 165/153; 29/890.043

[58] Field of Search ..... 165/153, 173; 29/890.043; 62/515, 524

[56] References Cited

U.S. PATENT DOCUMENTS

| | | | |
|---|---|---|---|
| 513,620 | 1/1894 | Phillips | 29/890.043 |
| 2,099,186 | 11/1937 | Anderegg | 62/524 |
| 2,878,656 | 3/1959 | Domal | 62/524 |
| 2,996,600 | 8/1961 | Gardner, Jr. et al. | 29/890.043 |
| 3,782,450 | 1/1974 | Swozil | 165/173 |
| 4,221,263 | 9/1980 | Meyer | 165/173 |
| 4,244,194 | 1/1981 | Haesters et al. | 62/515 |
| 4,570,700 | 2/1986 | Ohara et al. | 165/134.1 |
| 4,586,566 | 5/1986 | Kern et al. | 165/173 |
| 4,749,033 | 6/1988 | Clausen | 165/173 |
| 4,943,001 | 7/1990 | Meyer | 165/173 |
| 5,046,555 | 9/1991 | Nguyen | 165/173 |
| 5,113,934 | 5/1992 | Potier | 165/173 |
| 5,178,211 | 1/1993 | Bauer et al. | 165/153 |
| 5,190,101 | 3/1993 | Jalilevand et al. | 165/173 |
| 5,219,024 | 6/1993 | Potier | 165/173 |

FOREIGN PATENT DOCUMENTS

| | | | |
|---|---|---|---|
| 2357992 | 5/1975 | Fed. Rep. of Germany | 165/173 |
| 140914 | 4/1980 | Fed. Rep. of Germany | 29/890.043 |
| 1201614 | 1/1960 | France | 165/173 |
| 1425677 | 12/1965 | France | 165/173 |
| 2553690 | 4/1985 | France | 29/890.043 |

*Primary Examiner*—John Rivell
*Assistant Examiner*—L. R. Leo
*Attorney, Agent, or Firm*—Wood, Phillips, VanSanten, Hoffman & Ertel

[57] ABSTRACT

The use of relatively heavy, large profile headers in a heat exchanger are avoided through a header construction wherein headers (20, 22) are formed of header plates (34) tapped with tank plates (36) having a concave surface (38) facing the header plate (34). The header plates (34) include a plurality of flanges (82) directed away from the tank plates (36) surrounding elongated slots (48). Each of the flanges (82) includes a pilot surface (80) extending about the associated slot (48) for receiving the end (90) of a flattened tube (20). The construction prevents the ends (90) of the tubes (28) from entering the header chambers (42) to a location whereat they could disrupt the flow of a heat exchange fluid therein to prevent uniform distribution of the same throughout the associated header (20, 22).

11 Claims, 4 Drawing Sheets

HEADER FOR AN EVAPORATOR

FIELD OF THE INVENTION

This invention relates to heat exchangers, and more particularly, to an improved header construction ideally suited for use in heat exchangers wherein flow of the heat exchange fluid within a header chamber is not to be influenced by the presence of the ends of tubes of the heat exchanger which enter the chamber through a header wall or the like. One typical use is in an evaporator for a refrigerant.

BACKGROUND OF THE INVENTION

Recent years have seen the expenditure of considerable effort to reduce the size of various heat exchangers, particularly those used in air conditioning systems and even more particularly, those used in vehicular air conditioning systems. At the same time, heat exchange efficiency cannot be lost as the heat exchangers are down-sized.

Size reduction typically results in weight reduction which, in a given vehicle, can improve fuel economy. Furthermore, a size reduction permits greater freedom in designing the envelope, i.e. vehicle body, in which the heat exchanger will be housed. This, in turn, allows the achievement of designs that are more aerodynamically clean. This, in turn, provides another source of fuel savings.

Moreover, reduction in size frequently means that the refrigerant charge may be reduced as well. Given that most common refrigerants today are chloro fluoro carbons or so called "CFC's", and given further that CFC's have a deleterious effect on the ozone layer, a reduction in refrigerant charge reduces the amount of refrigerant that is potentially available to leak to the atmosphere.

Hydrochlorofluoro carbons (HCFC's) suggested a replacement for CFC's have adverse global warning potential.

In the quest for size and weight reduction, some effort has been focused on header construction. Headers are, of course, necessary to properly distribute the heat exchange fluid to one or more flow paths in which heat is exchanged. However, the headers themselves do not contribute significantly to heat exchange between fluids. Thus, to the extent that a header occupies part of a given envelope, it represents a reduction in that part of the envelope that may be devoted to the components primarily responsible for heat exchange, namely, tubes interconnecting the headers and fins extending between the tubes or runs of a tube.

At the same time, headers may be required to withstand substantial pressures. For example, it is not uncommon to design headers for use with condensers in vehicular air conditioning systems to withstand pressures approaching 2000 psi, even though such a pressure is substantially in excess of normal working pressure within the system.

To meet these and other objectives, the use of tubular headers has been proposed for heat exchangers used in vehicular air conditioning systems. See, for example, U.S. Pat. No. 4,998,580, issued Mar. 12, 1992, to Guntly et al., the details of which are herein incorporated by reference. This heat exchanger utilizes cylindrical tubes as headers. The tubes are slotted at regular intervals and then flattened tubes are brazed into the slots with fins extending between adjacent flattened tubes.

This construction results in a light weight, low volume, heat exchanger capable of withstanding substantial pressures and having a high efficiency. It appears to be well on its way to recognition as the state-of-the-art automotive air conditioning condenser.

At the same time, further efforts are being made to reduce header size so as to maximize the amount of tube and fin surface that may be contained in a given envelope. A number of recent patents, including U.S. Pat. No. 4,903,389 issued Feb. 27, 1990 to Wolf, have disclosed what might be termed "laminated header constructions". In these constructions, typically a minimum of three relatively thin plates are sandwiched together. One plate on the exterior of the sandwich may be a cap plate while the opposite exterior plate in the sandwich may be a tube plate, receiving the ends of flattened tubes or the like. The center plate may contain a series of channels interconnecting the various slots in the tube plate to define, with the tube plate and the cap plate, a header chamber.

This type of construction is highly pressure resistant and is of minimal volume, allowing an increase in the percentage of any given envelope that may be devoted to tubes and fins. However, the use of three or more plates is not as efficient from the weight standpoint as other types of headers.

As a consequence, two lamination headers have evolved. In a typically two lamination header, one plate serves as a tube plate just as in a conventional laminated header. The other plate is stamped to include one or more concave channels or troughs which face the tube plate. This plate may be termed a tank plate and the same is bonded to the tube plate and sealed thereto. As a consequence, the channels in the tank plate serve as header chambers' interconnecting slots in the tube plate. In the usual case, a two lamination header will occupy no more space than a conventional laminated header and yet will weigh considerably less since it permits the elimination of at least one plate in the conventional laminated header construction.

Unfortunately, two lamination headers cannot be used efficiently in heat exchangers employed as evaporators. Typically, some part of the sides of the channel stamped in the tank plate are caused to overly the slots in the tube plates so that tubes received in these slots have their excursion into the header chamber limited by interference with sides of the channel or channels formed in the tank plate. In the usual case, the ends of the tubes will extend a small distance into the header chamber and thus each tube end acts as a small fence around the end of the associated flow path defined by tube itself. Where attempts are made to eliminate this small fence, part of the tank plate that fits flush against the tube plate must overly each slot and thus tends to partially occlude the tube receiving opening.

In either case, flow of refrigerant within the header chamber to the tubes is interfered with and one consequence is that the distribution of the refrigerant, which will be at least partially in the liquid phase when the heat exchanger is being used as an evaporator, is poor from one side of the evaporator to the other. And, the poor distribution, in turn, results in inefficient heat transfer.

This difficulty cannot be easily solved by return to the use of tubular headers as disclosed in the previously identified U.S. Pat. No. 4,998,580. Those skilled in the art will readily recognize that the tube ends will also act as fences in such a construction, simply because the side of the tubular headers through which they enter is not flat.

The present invention is directed to solving one or more of the above problems.

SUMMARY OF THE INVENTION

It is the principal object of the invention to provide a new and improved heat exchanger. More specifically, it is an object of the invention to provide a new and improved heat exchanger useful as an evaporator for the refrigerant.

An exemplary embodiment of a heat exchanger made according to the invention contemplates the provision of a header defined by a header plate having a tank construction bonded to one side thereof and sealed in relation thereto. The tank construction is convex away from the header plate so as to define a header chamber with the header plate. At least one tube slot is disposed in the header plate and a flange is provided to surround each such tube slot and to extend from the header plate in the direction opposite both the header chamber and the tank construction. A pilot surface is formed in the flange around each slot and a tube is sealed and bonded to each of the flanges. Each tube is slightly larger in dimension than the corresponding slot and of slightly lessor dimension than the corresponding pilot surface.

As a consequence of this construction, the tube does not enter the header chamber and yet is in fluid communication with the same so that the flow of heat exchange fluid within the header chamber is not influenced by part of the tube therein.

In a highly preferred embodiment, the heat exchanger is an evaporator for a refrigerant.

A highly preferred embodiment of the invention contemplates that the pilot surface be in the form of a bevel. Preferably, the pilot surface extends peripherally around the interior of the associated flange.

According to still another facet of the invention, there is provided an improvement in a heat exchanger of the type including a header plate having a plurality of slots, each surrounded by a flange, a tank construction affixed and sealed to one side of the plate to define a header chamber, an inlet to the chamber, and a plurality of tubes having open ends received in the slots to be in fluid communication with the chamber and bonded to the flanges to be sealed thereto. The improvement contemplated is that the heat exchanger specifically be an evaporator for the refrigerant and that the flanges extend away from the header plate in the direction opposite the tank.

The invention also contemplates a method of forming a heat exchanger particularly useful as an evaporator. A tube plate is provided with a peripheral side flange and a dimple. A slot is punched in the dimple and a pilot formed around the slot within the flange. A tank plate, tube and fins are assembled and fixtured, and the assembly placed in a brazing oven to be brazed therein. After bonding by brazing is achieved, the assembly and the fixture are removed from the oven, the fixture removed and the resulting heat exchanger inspected and/or tested.

Other objects will become apparent from the following specification taken in connection with the accompanying drawings.

DESCRIPTION OF THE PREFERRED EMBODIMENT

Figure 1:
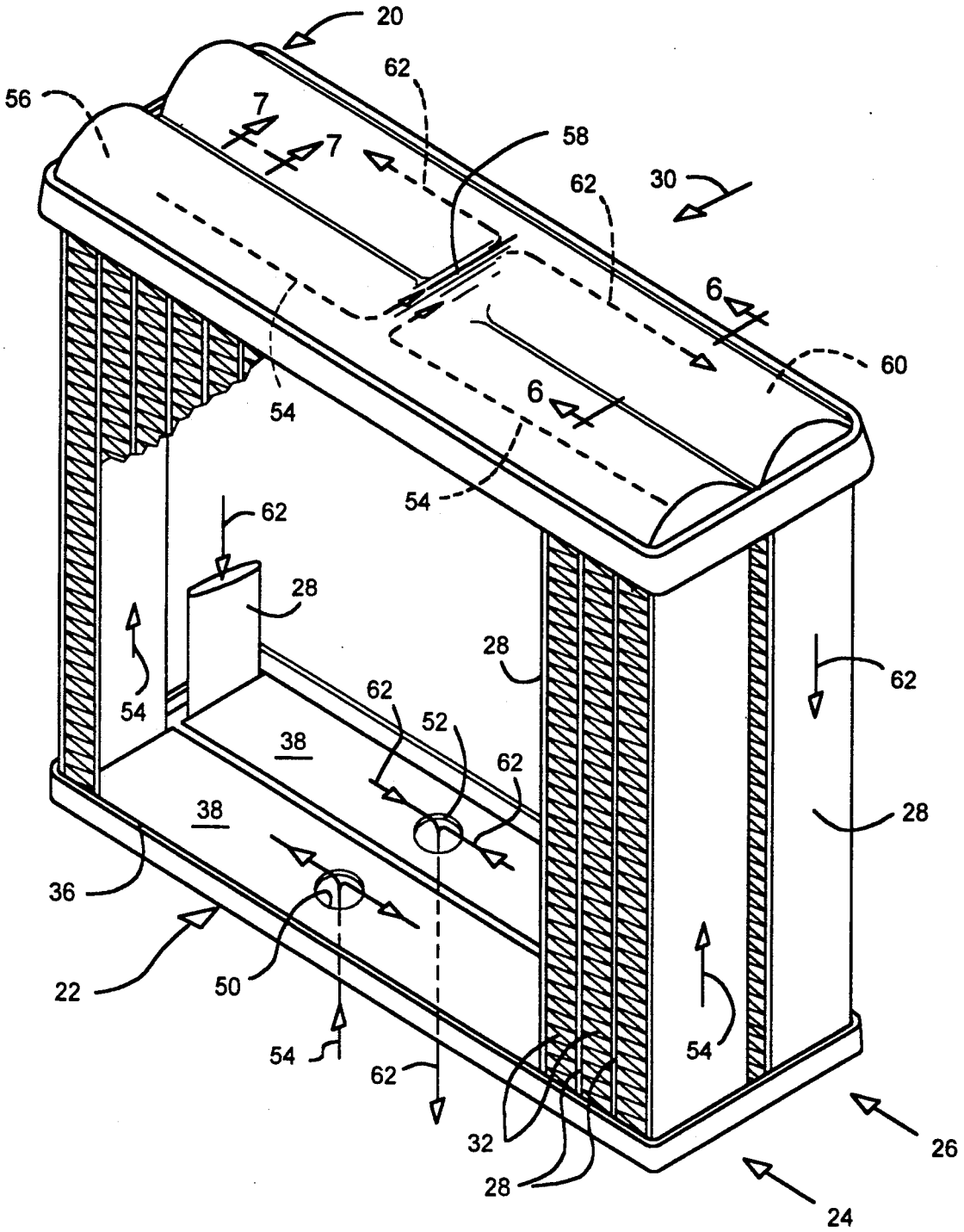
FIG. 1 is a perspective view of a heat exchanger, specifically, a two-pass evaporator for a refrigerant, made according to the invention.

An exemplary embodiment of the invention is illustrated in FIG. 1 in the form of a two-row, multiple-pass evaporator for a refrigerant. However, it is to be understood that the principles of the invention may be used with efficacy in heat exchangers other than evaporators, particularly when there is concern for a uniform distribution of a heat exchange fluid on the interior of the heat exchanger.

With the foregoing in mind, the invention will now be described.

As seen in FIG. 1, the evaporator include upper and lower headers, generally designated 20 and 22 respectively. Extending between the headers 20 and 22 are two rows, generally designated 24 and 26, of flattened tubes 28. When the heat exchanger is an evaporator, air flow through the same will be in the direction of an arrow 30 so that the tube row 26 will be the front row and the tube row 24 will be the rear most row.

The tubes 28 are geometrically in parallel as well as hydraulically in parallel. Serpentine fins 32 extend between and are bonded to adjacent ones of the tubes 28.

Figure 6:
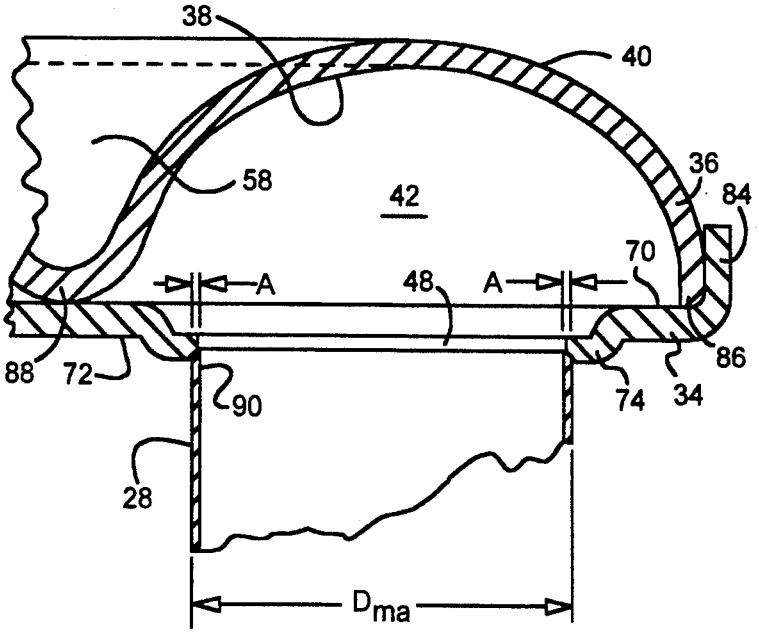
FIG. 6 is a fragmentary, sectional view taken approximately along the line 6—6 in FIG. 1.

As seen in FIG. 6, each of the headers 20 and 22 is formed of a header plate 34 and a tank plate 36, both of which will be described in greater detail hereinafter. For present purposes, it will be seen that the tank plate 36 has a concave side 38 facing the header plate 34 as well as a convex side 40 directed away from the header plate 34. The tank plate 36 is typically bonded and sealed to the header plate 34 and because of the concave side 38, one or more header chambers 42 is defined.

Figure 2:
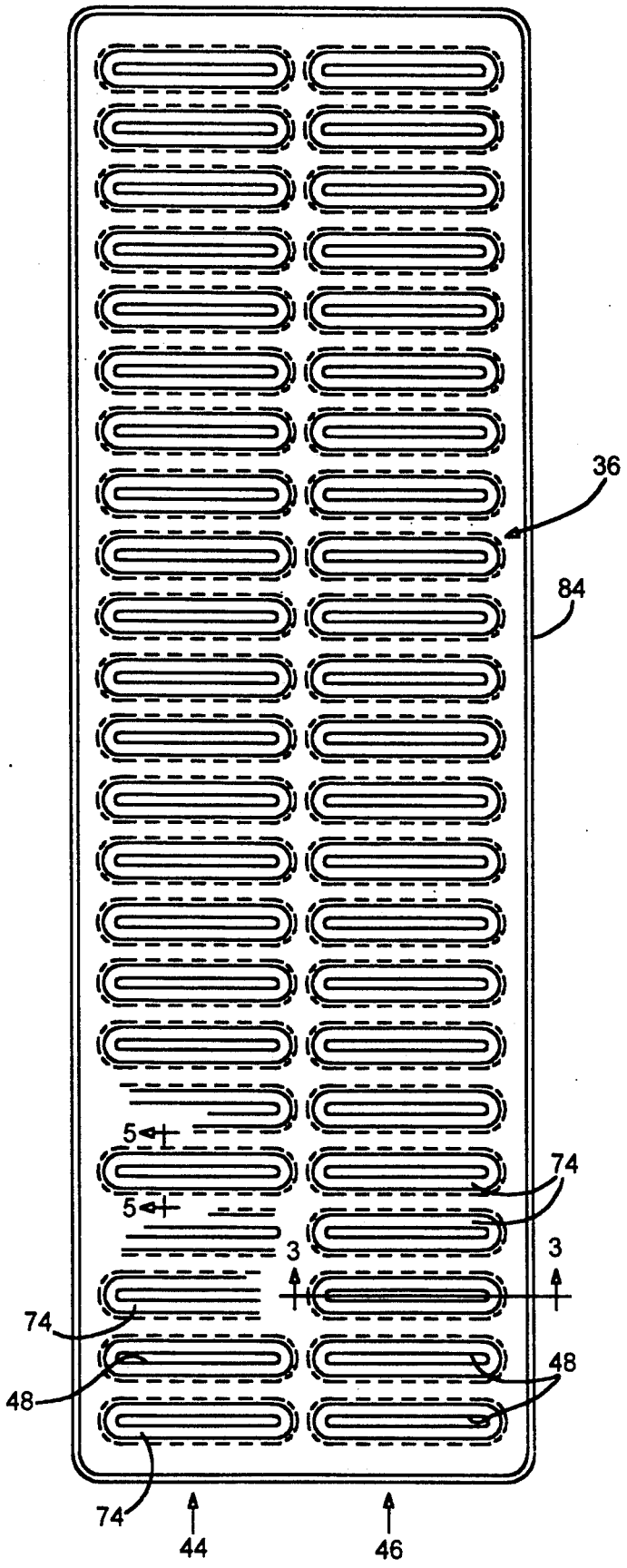
FIG. 2 is a plan view of a header plate.

As seen in FIG. 2, each header plate includes two rows, generally designated 44 and 46, of elongated slots 48. The tubes 28 are received in and bonded to the slots 48 to be sealed therein.

As viewed in FIG. 1, the lower header 22 is shown with its associated header plate 34 removed. Thus it can be seen that the tank plate 36 has two, elongated, side-by-side concave surfaces 38 to define two side-by-side header chambers, one for the row 24 and another for the row 26. A refrigerant inlet 50 is associated with the concave surface 38 for the row 24 while a refrigerant outlet 52 is located in the concave surface 38 associated with the row 26. It will be observed that both the inlet 50 and the outlet 52 are at the approximate midpoints of the associated concave surfaces 38.

As a consequence of the foregoing, as indicated by a series of arrows 54, incoming refrigerant, which will be at least partially in the liquid phase, will enter the inlet 50 to be directed towards respective ends of the heat exchanger core thus described. It will enter the tubes 28 to pass upwardly therein to a header chamber 56 associated with the row 24 of tubes 28 and being part of the upper header 20. The refrigerant will flow towards the center of the header chamber 56 and a cross-over bridge 58 stamped in the associated tank plate 36. The cross-over bridge 58 extends to a second header chamber 60 in the header 20 and associated with the row 26 of tubes 28. The cross-over bridge 58 is located at the approximate center of the header chambers 56 and 60.

Refrigerant exiting the cross-over bridge 58 flows in the direction of arrows 62 towards the respective ends of the header chamber 60 and will pass through the tubes 28 downwardly in the row 26 to the lower header 22 where it is gathered from the various tubes 28 in the row 26 and directed to the outlet 52.

It has been found that a flow pattern such as just described provides a highly efficient evaporator, particularly when good distribution of refrigerant from one side of the core to the other is achieved. Good distribution is enhanced by the central locations of the inlet 50, outlet 52 and cross-over bridge 58 in the manner just described. It is also enhanced by the relationship of the tubes 28 to the respective header plates 34 and the slots 48 therein as will be described. Referring to FIG. 2–5, inclusive, each header plate 34 has opposite sides 70 and 72.

A plurality of elongated, relatively narrow dimples 74 are formed in the two rows 44 and 46 (FIG. 2) in each of the header plates 34. As perhaps best seen in FIG. 3, each dimple 74 is concave toward the surface 70 and convex from the surface 72. As seen in FIG. 4, the interior side 76 of each dimple is at approximately 60 degrees to the plane of the surface 70. Thus, each dimple 74 projects away from the surface 70 and thus away from the tank plate 36 as seen FIG. 4 and 6.

Each dimple 74 is formed by a die having a configuration approximately that of the surface 76. Once the dimples are formed, a similar die but with an open, slotted interior is disposed within each of the dimples 74 to support the same. Then, a punch is applied toward the surface 72 and the center of each dimple 74 to punch out each of the slots 48. The slug resulting from the punching operation enters the slot in the support die.

Figure 3:
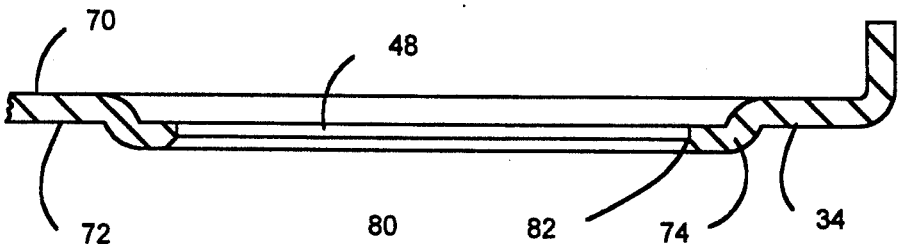
FIG. 3 is a sectional view taken approximately along the line 3—3 in FIG. 2.
Figure 4:
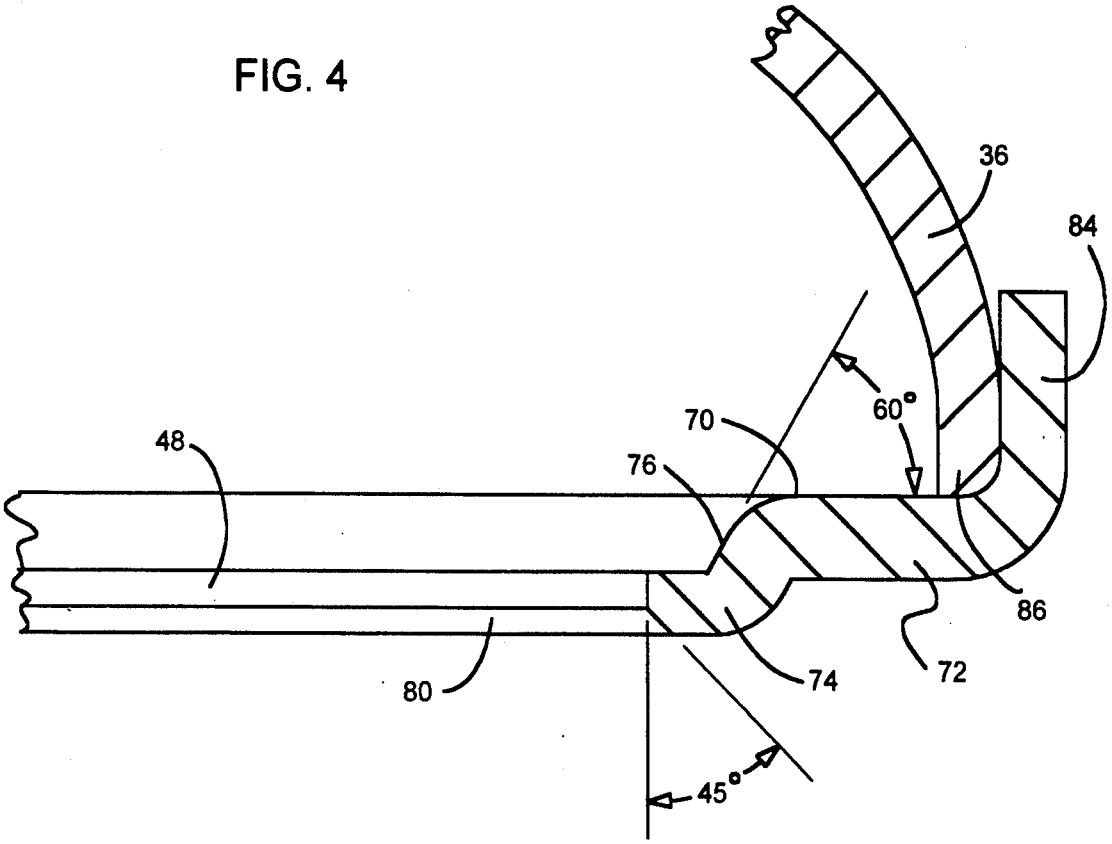
FIG. 4 is an enlarged, fragmentary view of part of an assembled header made according to the invention.
Figure 5:
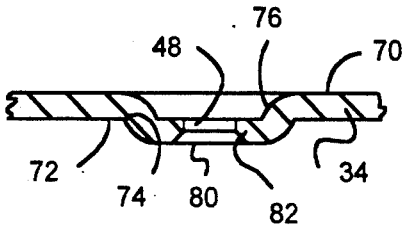
FIG. 5 is an enlarged, sectional view taken approximately along the line of 5—5 in FIG. 2.

Preferably, the punch used to form each of the slots 48 is provided with a peripheral, beveled surface so as to form a 45 degree bevel 80 (FIG. 4) around the entire periphery of each of the elongated slots 48 as can be readily ascertained from FIG. 3 and 5. The surface 80 acts as a pilot surface as will be seen. As a consequence, each of the slots 48 is surrounded by a peripheral flange 82 defined by a punched out one of the dimple 74. Each such flange 82 includes the beveled pilot surface 80 in surrounding relation to the associated slot 48.

In addition to the foregoing, the header plate 34 is optionally provided with a peripheral side flange 84 and each of the tank plates 36 includes edges 86 that are received within the confines of the side flange 84 and in abutment with the surface 70 as can be seen in FIGS. 4 and 6. In addition, each tank plate 36 includes a central ridge 88 separating the two concave surfaces 38 and generally in the plane of the edges 86.

In the preferred embodiment, the components are formed of braze clad aluminum. Thus, when the tank plate 36 is disposed on a header plate 34 as illustrated in FIG. 6, a subsequent brazing operation will result in the tank plate 36 being bonded to as well as sealed to the header plate 34 at the edges 86 and the ridge 88. To this end, both sides of the header plate 34 will be braze clad. The side 70 will be braze clad so as to facilitate bonding between the header plate 34 and the tank plate 36 whereas the side 72 will be braze clad so as to facilitate bonding of the tubes 28 to the header plates 34. In this way, the tank plates 36 and flattened tubes 28 need not be braze clad, providing a considerable savings for, as is well known, braze clad aluminum sheet is considerably more expensive than unclad aluminum sheet. Alternatively, if the tubes 28 are to be braze clad on their exterior surface to facilitate bonding with the serpentine fins 32, it may be possible to omit braze clad on the side 72 of each header plate 34. Where, however, the tubes 28 are not braze clad on their exterior, then it is necessary that the stock used to form the serpentine fins 32 be braze clad on both sides thereof.

Figure 7:
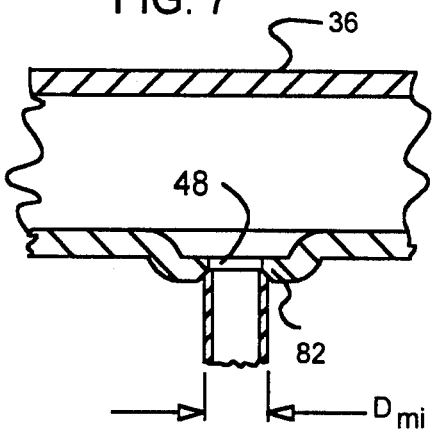
FIG. 7 is a fragmentary, sectional view taken approximately along the line 7—7 in FIG. 1.

According to the invention, the tubes 28 have a major dimension $D_{ma}$ as illustrated in FIG. 6 and a minor dimension $D_{mi}$ as is illustrated in FIG. 7. According to the invention, the major dimension of each tube 28 is slightly greater than the corresponding dimension of the associated slot 48. At the same time, it is slightly less than the largest dimension of the associated pilot surface 80. Also, the minor dimension, $D_{mi}$ may be identical to the narrow dimension of the slot 48 as illustrated in FIG. 7.

Figure 8:
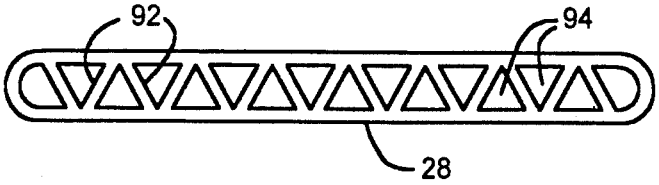
FIG. 8 is a cross-section of a flattened tube used in the invention.

In any event, in the process of fabricating the evaporator, ends 90 of the tubes are directed towards associated slots 48 in the header plates 34. They encounter the pilot surfaces 80 which exert a camming force on the ends 90 so as to position them properly with respect to the slots 48. Because flattened tubes, particularly when fabricated from sheet as opposed to being extruded, have greater structural integrity along their major dimension than across their minor dimension, the major dimension is the one that is employed for piloting purposes. Consequently, any tendency of one of the tube ends 90 to collapse, even slightly across its minor dimension, will not affect the ability to properly position the tubes 28 with respect to the header plates 34 to achieve a good bond and seal with respect thereto. The tubes 28, preferably, are tubes containing a plurality of internal webs 92 as illustrated in FIG. 8 to divide the interior of each tube into a plurality of flow channels 94. The tubes 28 may be formed by extrusion or, if desired, in the fashion disclosed in U.S. Pat. No. 4,688,311 issued Aug. 25, 1987, to Saperstein et al., the details of which are herein incorporated by reference. Preferably, the channels 94 will be of relatively small hydraulic diameter which usually will be about 0.070 inches or less. Hydraulic diameter is as conventionally defined, namely, the product of the cross sectional area of the corresponding flow path and four (4), divided by the wetted perimeter of the corresponding flow path.

Figure 9:
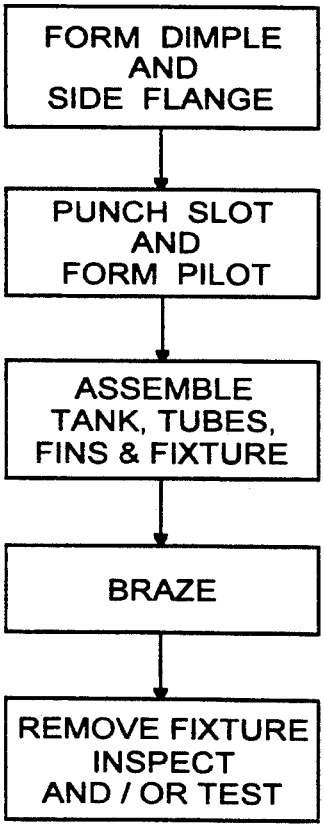
FIG. 9 is a block diagram showing certain steps in a process of fabricating a heat exchanger according to the invention.

The entire core as illustrated in FIG. 1 is assembled of loose parts and held in the configuration illustrated by any suitable fixture. Thereafter, the fixture with the assembly will be placed in a brazing oven and subject to brazing temperatures until brazing is achieved. Thereafter, the fixture and the assembly may be removed from the brazing oven, the fixture removed from the core, and the same inspected and/or tested. Generally speaking, the steps in the assembly process are illustrated in block form in FIG. 9.

Of course, in those brazing processes requiring the application of a flux, a suitable flux will be applied to all parts of the assembly that are to be bonded together prior to the step of brazing.

As a consequence of the foregoing, it will be readily appreciated that the tube ends 90 do not extend into the header chambers 42 whereat they could act as fences around any given one of the slots 48 and the open end 90 of the associated tube 28. Such fences would interfere with the flow of refrigerant, particularly the flow of the refrigerant in the liquid phase, and adversely affect refrigerant distribution leading to poor evaporator efficiency.

Furthermore, even where tolerances may result in an end 90 of a tube 28 fully entering a slot 48, that is, moving past the position illustrated in FIG. 6 in the direction of the header chamber 42, the tube end 90 will typically remain within the concave side of the associated dimple 74. That is to say, it will not extend past the plane of the surface 70.

As a consequence, the tube end 90 being within the dimple 74 will not interfere with desired refrigerant flow and distribution within the associated header chamber 42 and good distribution for high evaporator efficiency will still be obtained. Thus, directing the flanges 82 away from the tank plate 36 provides a means of assuring good refrigerant distribution.

At the same time, the header construction has a low profile associated with laminated constructions and thus maximizes the area available to be occupied by tubes 28 and fins 32. In addition, because each header 20, 22 is of the two lamination variety, the lesser weight advantages of two lamination headers continue to be enjoyed.

We claim:

1. In a heat exchanger including a header plate having a plurality of slots each surrounded by a flange, a tank construction bonded and sealed to one side of the plate to define a header chamber, an inlet to said chamber, and a plurality of tubes having open ends received in said slots to be in fluid communication with said chamber and bonded to said flange to be sealed thereto, the improvement wherein:

said heat exchanger is an evaporator for a refrigerant; and said flanges extend away from said header plate in the direction opposite said tank construction so that the open ends of said tubes are removed from said chamber by said flanges to improve refrigerant distribution within said chamber; and including a pilot surface on the interior of each said flange for piloting an associated tube end toward the associated slot; said pilot surface being a bevel.

2. The heat exchanger of claim 1 wherein said tube surface extends peripherally around the interior of the associated flange.

3. In a heat exchanger including a header plate having a plurality of slots each surrounded by a flange, a tank construction bonded and sealed to one side of the plate to define a header chamber, an inlet to said chamber, and a plurality of tubes having open ends received in said slots to be in fluid communication with said chamber and bonded to said flanges to be sealed thereto, the improvement wherein:

said heat exchanger is an evaporator for a refrigerant; and said flanges extend away from said header plate in the direction opposite said tank construction so that the open ends of said tubes are removed from said chamber by said flanges to improve refrigerant distribution within said chamber; and wherein said tube ends do not extend past the surface of the header plate opposite the flanges so as not to extend into said chamber; said flanges having an internal beveled pilot surface and said tube ends having a dimension slightly greater than at least one corresponding dimension of the slots in which they are received, said tube end dimension further being less than the largest corresponding dimension of said beveled pilot surface.

4. The heat exchanger of claim 3 wherein said tubes are flattened tubes and said tube end dimension is the tube major dimension.

5. An evaporator for a refrigerant comprising:

a header plate having a plurality of slots each surrounded by a flange;

a tank construction bonded and sealed to one side of the plate to define a header chamber;

a refrigerant inlet to said chamber;

and a plurality of tubes having open ends received in said slots to be in fluid communication with said chamber and bonded to said flanges to be sealed thereto;

a beveled pilot surface on the interior of each said flange and at the end thereof remote from said header plate;

said flanges extending away from said header plate in the direction opposite said tank and mounting said tube open ends in contact with an associated pilot surface and out of said chamber to prevent said open ends from interfering with refrigerant distribution within said chamber.

6. The exchanger of claim 5 wherein said tubes are flattened tubes and are parallel with each other, and said slots are elongated.

7. The exchanger of claim 5 wherein each of said tubes has a plurality of integral webs dividing, its interior into a plurality of internal flow channels, each of relatively small hydraulic diameter.

8. A heat exchanger comprising:

a header defined by a header plate having a tank construction bonded to one side thereof in sealed relation thereto, said tank construction being convex away from said header plate so as to define a header chamber therewith;

at least one tube slot in said header plate;

a flange surrounding each said tube slot and extending from said header plate in the direction opposite both said header chamber and said tank construction;

a beveled pilot surface formed in said flange around each said slot; and a tube sealed and bonded to each said flange, each tube being of slightly larger dimension than a corresponding slot and slightly lesser dimension than a corresponding beveled pilot surface;

whereby each said tube does not enter said header chamber while being in fluid communication with the header chamber so that flow of a heat exchange fluid within said header chamber is not influenced by part of each said tube therein.

9. A heat exchanger comprising:

a header defined by a header plate and having a tank construction bonded to one side thereof in sealed relation thereto, said tank construction being convex away from said header plate so as to define a header chamber therewith;

a plurality of dimples in said header plate in spaced relation, said dimples being concave on the side of said header adjacent said tank and convex on the side of said header remote from said tank;

a tube receiving opening in each of said dimples, each of said tube receiving openings being beveled about the side thereof remote from said tank; and a tube having an end received within each of said openings and sealed and bonded to said header plate, each said tube being of slightly larger dimension than the corresponding tube receiving opening and of slightly lesser dimension than the corresponding bevel; whereby each of said tube does not enter the header chamber through an associated tube receiving opening but is spaced therefrom by said dimple so that flow of a heat exchange fluid within the header chamber is not influenced by any part of the tube extending thereinto.

10. The heat exchanger of claim 9 wherein said dimples are elongated, said tube receiving openings are elongated slots and said tubes are flattened tubes.

11. The heat exchanger of claim 10 wherein each of said flattened tubes has a major dimension and a minor dimension and said slightly larger dimension is the tube major dimension.

* * * * *

UNITED STATES PATENT AND TRADEMARK OFFICE

CERTIFICATE OF CORRECTION

PATENT NO. : 5,327,959
DATED : July 12, 1994
INVENTOR(S) : Z. Philip Saperstein, Gregory G. Hughes, Dan R. DeRosia, Dennis C. Granetzke, Jeff A. Logic It is certified that error appears in the above-indentified patent and that said Letters Patent is hereby corrected as shown below:

Claim 2, column 7, line 54, delete "tube" and substitute --pilot --.

Signed and Sealed this

Thirty-first Day of January, 1995

*Attest:*

Bruce Lehman

BRUCE LEHMAN

*Attesting Officer*

*Commissioner of Patents and Trademarks*